US008421731B2

(12) United States Patent
Miyabe

(10) Patent No.: US 8,421,731 B2
(45) Date of Patent: Apr. 16, 2013

(54) LIQUID CRYSTAL DISPLAY DEVICE WITH REDUCED POWER CONSUMPTION IN STANDBY MODE

(75) Inventor: Seiji Miyabe, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 696 days.

(21) Appl. No.: 12/250,157

(22) Filed: Oct. 13, 2008

(65) Prior Publication Data

US 2009/0096777 A1 Apr. 16, 2009

(30) Foreign Application Priority Data

Oct. 12, 2007 (JP) ..... 2007-267144

(51) Int. Cl.
*G09G 3/36* (2006.01)

(52) U.S. Cl.
USPC ..... 345/99; 345/211

(58) Field of Classification Search ..... 345/99, 345/211–213
See application file for complete search history.

(56) References Cited

U.S. PATENT DOCUMENTS 5,815,133 A 9/1998 Tsuboyama et al.
6,020,879 A * 2/2000 Nakabayashi ..... 345/212
6,693,614 B2 * 2/2004 Kamiya et al. ..... 345/89
2001/0020928 A1 9/2001 Yanagisawa et al.
2002/0105490 A1 8/2002 Kanbe et al.
2005/0206638 A1 * 9/2005 Wakimoto et al. ..... 345/209

FOREIGN PATENT DOCUMENTS

JP 11-177895 A 7/1999

OTHER PUBLICATIONS

Extended European Search Report dated Apr. 13, 2010 (Eight (8) pages).
European Office Action dated Nov. 4, 2011 (eight (8) pages).

* cited by examiner

*Primary Examiner* — Chanh Nguyen
*Assistant Examiner* — Roy Rabindranath
(74) *Attorney, Agent, or Firm* — Crowell & Moring LLP

(57) ABSTRACT

A data driver outputs image data to a liquid crystal panel, using a trailing edge of a timing signal as a trigger. When a user operates a remote control for power-off, a main controller outputs, to a driver controller, a stop signal for stopping the timing signal, and a power switching signal for switching the image data to a low power for output after a predetermined time from the stop signal. Accordingly, the image data is switched to a low power for standby mode after the supply of the timing signal to the data driver is completely stopped. Thus, when the data driver outputs image data to the panel in response to a last pulse of the timing signal, the data driver is prevented from outputting image data having been switched to a low power, so that noise can be prevented from appearing on the screen of the panel.

1 Claim, 2 Drawing Sheets

LIQUID CRYSTAL DISPLAY DEVICE WITH REDUCED POWER CONSUMPTION IN STANDBY MODE

BACKGROUND OF THE INVENTION

1. Field of the Invention

The present invention relates to a liquid crystal display device.

2. Description of the Related Art

As shown in FIG. 3, for example, a liquid crystal television receiver (hereafter simply referred to as "liquid crystal television") 100 comprises a receiving unit 101 including a tuner for outputting a video signal VS, and a signal processing unit 102 for processing the video signal VS in a predetermined manner as well as a data driver 103 and a gate driver 104 for receiving and supplying the thus processed video signal VS to a liquid crystal panel 105. Normally, the liquid crystal television 100 is designed such that when a user presses a power button of a remote control to turn off the power of the liquid crystal television 100, the mode of the liquid crystal television 100 is switched from the power-on mode to the standby mode. For switching the power-on mode to the standby mode, the power (voltage) of image data output from the signal processing unit 102 to the data driver 103 is switched to a lower power (lower voltage) than in the power-on mode.

In the standby mode, the power consumption of the liquid crystal television 100 is reduced compared with the power-on mode. In addition, when the user operates the remote control to turn on the liquid crystal television 100 in the standby mode, the rise time of the liquid crystal panel 105 is reduced, that is, the rise time from the standby mode to the power-on mode is shorter than that from the power-off mode to the power-on mode. However, such conventional liquid crystal television 100 has a problem that as shown in FIG. 4, a bright (medium bright) vertical line L (line-shaped noise) may occasionally appear momentarily on the screen of the liquid crystal panel 105 when a user turns off the liquid crystal television 100. Such bright vertical line L or noise looks bad and is annoying. In addition, there is a possibility that some users may consider it as a defective product.

In this regard, it is known to convert image data to black data in order to prevent such noise from appearing on the screen of a television receiver (refer, for example, to Japanese Laid-open Patent Publication Hei 11-177895). Thus, for the purpose of solving the above-described problem (appearance of line-shaped noise) in the liquid crystal television 100, it may be considered to convert the image data to black data when turning off the liquid crystal television 100. However, this decreases the effect of reducing the power consumption compared with the case of making the output of the image data zero, because additional power is needed to output the black data.

SUMMARY OF THE INVENTION

An object of the present invention is to provide a liquid crystal display device that outputs image data from a data driver at predetermined intervals and switches the output of the image data to the data driver to a low power when turned off to change its mode from the power-on mode to the standby mode, and that can sufficiently reduce its power consumption in the standby mode and, at the same time, can prevent line-shaped noise from occurring when turned off.

According to the present invention, this object is achieved by a liquid crystal display device comprising: a liquid crystal panel; a data driver for outputting image data to the liquid crystal panel; timing signal output means for supplying a timing signal to the data driver for allowing the data driver to output image data at predetermined intervals; image data output means for switching image data from an image data source such as a tuner between a low power signal for standby mode and a high power signal for normal mode so as to output, to the data driver, the image data as either the low power signal or the high power signal; and power-off control means for outputting a stop signal to the timing signal output means, when a user selects power-off, so as to allow the timing signal output means to stop the supply of the timing signal, and for outputting a power switching signal to the image data output means so as to allow the image data output means to switch the image data to the low power signal for standby mode, wherein the power-off control means allows the image data output means to switch the image data to the low power signal after the timing signal output means stops the supply of the timing signal.

Preferably, the power-off control means outputs the power switching signal after outputting the stop signal, so as to allow the image data output means to switch the image data to the low power signal after the timing signal output means stops the supply of the timing signal. Further preferably, the timing signal is a pulse signal having pulses at predetermined intervals, each having a leading edge and a trailing edge, wherein the time from when the power-off control means outputs the stop signal to when the power-off control means outputs the power switching signal is a sufficient time to allow the image data output means to switch the image data to the low power signal for output after the trailing edge of a last pulse of the timing signal output from the timing signal output means. Still further preferably, the time from when the power-off control means outputs the stop signal to when the power-off control means outputs the power switching signal is shorter than each of the intervals of the timing signal output from the timing signal output means.

The present invention is based on knowledge obtained by studying the above-described problems of the liquid crystal television, and thereby finding the cause of the line-shaped noise on the screen of the liquid crystal panel. According to the present invention, the image data is switched to a low power signal for output after the supply of the timing signal to the data driver to provide the output timing of the image data is stopped. This makes it possible to surely prevent line-shaped noise from occurring when power-off (when the liquid crystal display device is turned off), and to sufficiently reduce the power consumption of the liquid crystal display device in standby mode.

While the novel features of the present invention are set forth in the appended claims, the present invention will be better understood from the following detailed description taken in conjunction with the drawings.

BRIEF DESCRIPTION OF THE DRAWINGS

The present invention will be described hereinafter with reference to the annexed drawings. It is to be noted that all the drawings are shown for the purpose of illustrating the technical concept of the present invention or embodiments thereof, wherein.

Figure 3:
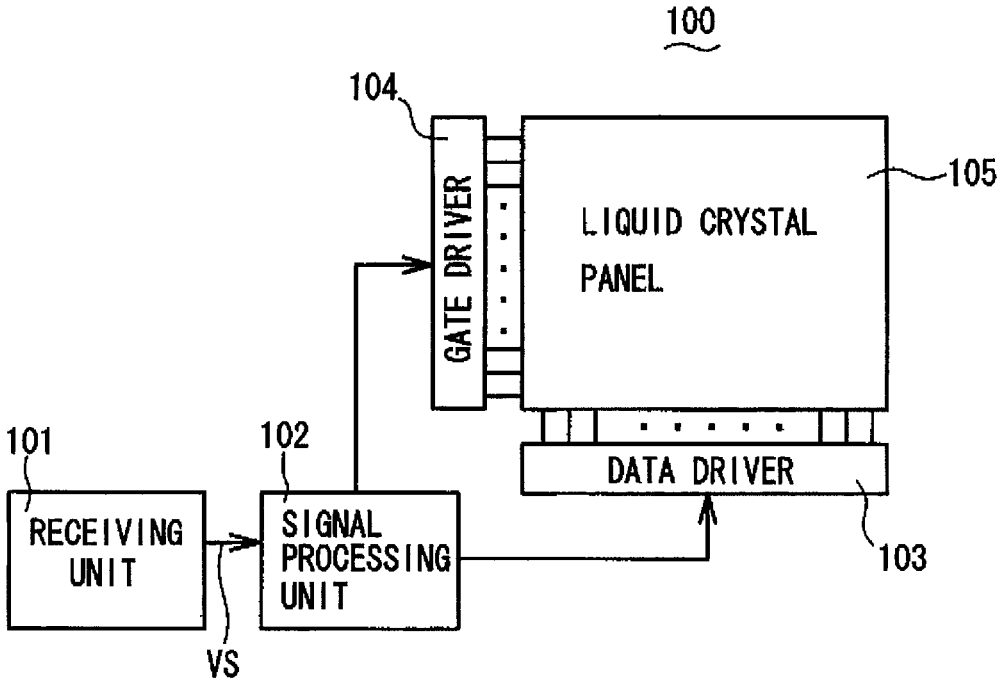
FIG. 3 PRIOR ART
Figure 4:
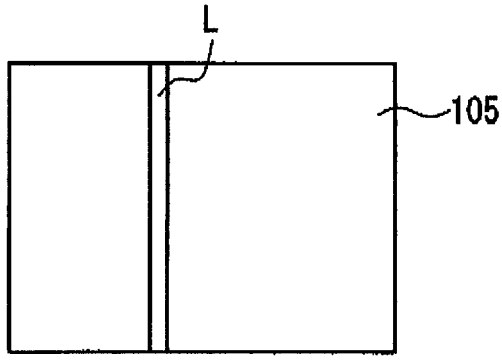
FIG. 4 PRIOR ART

FIG. 3 is a schematic block diagram of a main part of a conventional liquid crystal television receiver; and FIG. 4 is a schematic view of a liquid crystal panel of the conventional liquid crystal television receiver, showing noise appearing on a screen of the liquid crystal panel when turning off the power of the liquid crystal television receiver.

DESCRIPTION OF THE PREFERRED EMBODIMENTS

The best modes and preferred embodiments of the present invention will be described hereinafter with reference to the annexed drawings. The specific embodiments described are not intended to cover the entire scope of the present invention, and hence the present invention is not limited to only the specific embodiments.

Figure 1:
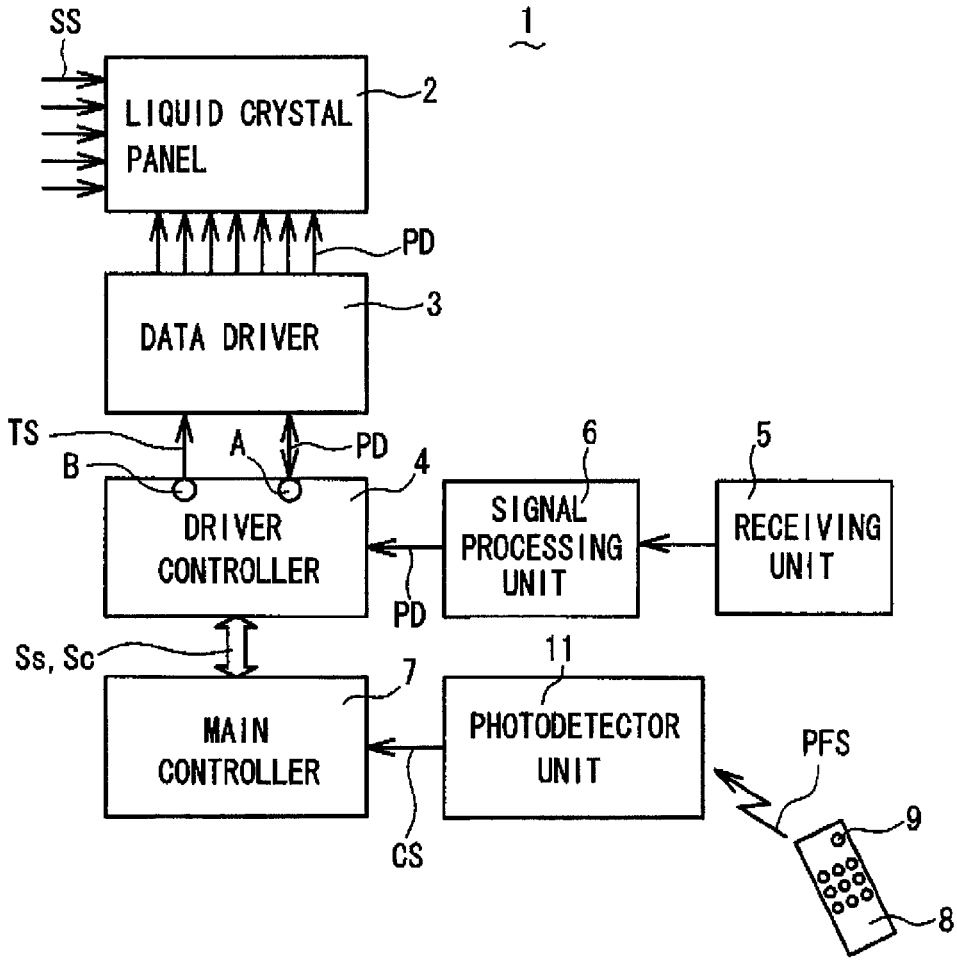
FIG. 1 is a schematic block diagram of a main part of a liquid crystal television receiver according to an embodiment of the present invention.
Figure 2:
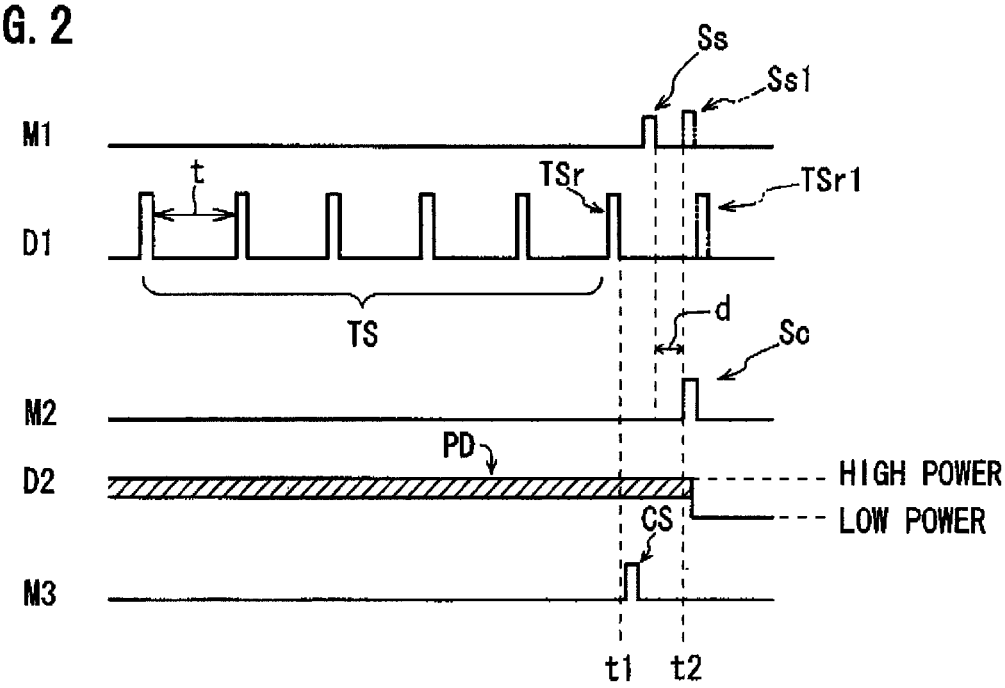
FIG. 2 is a timing chart of signals M1, M2, M3, D1 and D2, in which signal D1 denotes a timing signal output from a driver controller, signal M1 denotes a stop signal output from a main controller for stopping the timing signal, signal M2 denotes a power switching signal output from the main controller for switching the power of image data, signal D2 denotes image data output from the driver controller, and signal M3 denotes a control signal received by the main controller for commanding power-off.

FIG. 1 is a schematic block diagram of a main part of a liquid crystal television receiver (hereafter simply referred to as "liquid crystal television") 1 as a liquid crystal display device according to an embodiment of the present invention, while FIG. 2 is a timing chart of signals M1, M2, D1, D2 and D3 which will be described later. FIG. 1 shows a main part of the liquid crystal television 1 including a liquid crystal panel 2 and a data driver 3 for outputting image data PD to the liquid crystal panel 2 as well as other main circuits and elements connected directly or indirectly to the data driver 3. FIG. 1 omits other circuits and elements including a gate driver for supplying a scan timing signal SS to the liquid crystal panel 2, a timing signal supplying circuit connected to the gate driver, a backlight of the liquid crystal panel 2 and a power supply circuit.

A driver controller 4 (so-called timing controller: claimed "timing signal output means" and "image data output means") formed of a microprocessor is connected to the data driver 3. The driver controller 4 receives image data PD output from a signal processing unit 6 which processes an output signal from a receiving unit 5 (claimed "image data source such as a tuner") including a tuner so as to generate the image data PD. The driver controller 4 further switches the received image data PD between a low power (low power signal) for standby mode and a high power (high power signal) for power-on mode (normal mode). More specifically, the driver controller 4 outputs, to the data driver 3, image data PD in the form of either a low power signal or a high power signal from an input/output port A thereof.

In the timing chart of FIG. 2, signal D1 denotes a timing signal TS output from the driver controller 4, while signal M1 denotes a stop signal Ss output from a main controller 7 (described below) for stopping the timing signal TS. On the other hand, signal M2 denotes a power switching signal Sc output from the main controller 7 for switching the power of the image data PD, while signal D2 denotes image data PD (low power signal or high power signal) output from the driver controller 4. Finally, signal M3 denotes a control signal CS received by the main controller 7 for commanding e.g. power-off. The timing signal TS is used to provide the data driver 3 with the output timing of the image data PD to the liquid crystal panel 2. As shown by signal D1 of FIG. 2, the timing signal TS is a pulse signal having pulses at predetermined intervals (constant interval t), each having a leading edge and a trailing edge, and is output from an output port B of the driver controller 4 to the data driver 3. Thus, the driver controller 4 supplies the timing signal TS to the data driver 3 so as to allow the data driver 3 to output image data at the predetermined intervals.

Referring to FIG. 1, the main controller 7 (claimed "power-off control means") formed of a microprocessor is connected to the driver controller 4. When a user presses a power key 9 of a remote control 8 to select power-off mode of the liquid crystal television 1 (i.e. when a user selects power-off), the main controller 7 outputs, to the driver controller 4, a stop signal Ss to stop the timing signal TS from the driver controller 4 as well as a power switching signal Sc for allowing the driver controller 4 to switch the power of the image data PD to a low power to output the image data PD as a low power signal. Note that the remote control 8 outputs an infrared signal, such as a power-off command signal PFS for commanding power-off, which is received by a photodetector unit 11 of the liquid crystal television 1 so as to be input to the main controller 7 as a control signal CS.

Next, referring to FIG. 2, the following describes details and operations of: the timing signal TS output from the driver controller 4; timing of switching, from high power (high power signal) to low power (low power signal), of the image data PD output from the driver controller 4 to the data driver 3; the stop signal Ss output from the main controller 7 for stopping the timing signal TS output from the driver controller 4; the power switching signal Sc for allowing the driver controller 4 to switch the power of the image data PD to a low power to output the image data PD as a low power signal; and the control signal CS output from the photodetector unit 11 for commanding e.g. power-off. Now, when the mode of the liquid crystal television 1 is switched to power-on mode (normal mode) to display images received by the receiving unit 5 on the liquid crystal panel 2, the driver controller 4 outputs image data PD with high power as a high power signal to the data driver 3 as shown by signal D2 of FIG. 2, and also outputs (generates) a timing signal TS of pulses at a constant interval t as shown by signal D1 of FIG. 2. Note that the hatched portion in signal D2 of FIG. 2 collectively represents RGB (red/green/blue) image data output from the driver controller 4.

While the liquid crystal panel 2 displays images, the data driver 3 outputs to the liquid crystal panel 2 the image data PD at the constant interval t, using the trailing edge of each pulse of the timing signal TS from the driver controller 4 as a trigger, and also feeds the same image data PD back to driver controller 4. Based on the image data fed back from the data driver 3, the driver controller 4 determines whether or not the data driver 3 operates normally. When the user next operates the remote control 8 to select power-off, the main controller 7 receives a control signal CS for commanding power-off, as shown by signal M3 of FIG. 2, from the photodetector unit 11. In response to the control signal CS, the main controller 7 first outputs a stop signal Ss as shown by signal M1 of FIG. 2 for allowing the driver controller 4 to stop the output of the timing signal TS therefrom. After a predetermined time d from the stop signal Ss, the main controller 7 outputs to the driver controller 4 a power switching signal Sc as shown by signal M2 of FIG. 2 for allowing the driver controller 4 to switch the power of the image data PD to a low power to output the image data PD as a low power signal.

Thus, the driver controller 4 stops the output of the timing signal TS in response to the stop signal Ss received thereby from the main controller 7 as shown by signal M1 and signal D1 of FIG. 2. The driver controller 4 further switches the power of the image data PD to a low power to output the image data PD as a low power signal in response to the power switching signal Sc received thereby from the main controller 7 as shown by signal M2 and signal D2 of FIG. 2. In signal D1 of FIG. 2, reference symbol TSr given to the rightmost timing signal TS (more specifically, last pulse of the timing signal TS) denotes a last timing signal (pulse) output from the driver controller 4 before the receipt of the stop signal Ss.

As described above, in the liquid crystal television 1 of the present embodiment, a stop signal Ss for stopping the timing signal TS is output, and thereafter a power switching signal Sc is output after a predetermined time d from the output of the stop signal Ss. In other words, in the liquid crystal television 1, a sufficient time of at least d is provided between the last timing signal TSr and the power switching signal Sc. More specifically, while the data driver 3 outputs image data PD to the liquid crystal panel 2 based on the timing signal TS received from the driver controller 4, the data driver 3 outputs the last image data PD using the trailing edge of the last timing signal TSr as a trigger at time t1 shown in FIG. 2. The power of the thus output last image data PD is kept high as a high power signal without fail due to the provision of the sufficient time of at least d before the output of the power switching signal Sc. This means that when the user operates the remote control 8 for power-off (turning off the liquid crystal television 1), the power of the image data PD then output to the liquid crystal panel 2 is kept high. It is a finding of the present invention that to keep the power of the output image data PD high when turning off the liquid crystal television 1 makes it possible to prevent a bright (medium bright) vertical line L (line-shaped noise) as shown in FIG. 4 from appearing on the screen of the liquid crystal panel 2.

In the following, by using FIG. 2, the reason for the prevention of a line-shaped noise (vertical line L) in the liquid crystal television 1 of the present embodiment will be described in comparison with a conventional device, which may cause a line-shaped noise (vertical line L). Now assume, as in a conventional device, that the main controller 7, which has received a control signal CS for power-off (turning off the power), outputs to the driver controller 4 both a stop signal Ss1 for stopping the timing signal TS (shown by a double dot-dashed line in signal M1 of FIG. 2) from the driver controller 4 and a power switching signal Sc simultaneously at time t2 shown in FIG. 2.

If the time t2 (for the main controller 7 to output both the stop signal Ss1 and the power switching signal Sc) is immediately before (or simultaneously with) the rise time of a pulse of the timing signal TS (in the pulses output at a constant interval t) such as timing signal TSr1 shown by a double dot-dashed line in signal D1 of FIG. 2, then it happens that the timing signal TSr1 as a last timing signal TS is output immediately after the stop signal Ss1 is output, and the power of the image data PD is switched to a low power (to be output as a low power signal) substantially simultaneously with the output of the timing signal TSr1. Thus, using the trailing edge of the last timing signal TSr1 as a trigger, the data driver 3 having received the last timing signal TSr1 outputs, to the liquid crystal panel 2, image data PD which is then output from the driver controller 4, and which has already been switched to a low power signal. The image data PD output as a low power signal appears on the screen of the liquid crystal panel 2 as a line-shaped noise (vertical line L).

In contrast to such conventional device, the main controller 7 of the liquid crystal television 1 according to the present embodiment outputs to the driver controller 4 a stop signal Ss for stopping the timing signal TS when the main controller 7 receives a control signal CS for power-off, and thereafter outputs to the driver controller 4 a power switching signal Sc after a predetermined time d from the stop signal Ss. Thus, the power of the image data PD is switched to a low power for output as a low power signal after the supply of the timing signal TS to the data driver 3 is completely stopped. This means that the image data PD is not yet switched to a low power signal when the data driver 3 outputs, to the liquid crystal panel 2, the image data PD using the trailing edge of the last timing signal TSr as a trigger as in the conventional device (i.e. conventional liquid crystal television), so that a bright (more precisely, medium bright) vertical line L (line-shaped noise) can be prevented from appearing on the screen of the liquid crystal panel 2. Besides, since the power of the image data PD is switched to the low power signal (for output to the data driver 3) by a user operating the remote control 8 for power-off, the power consumption of the liquid crystal television 1 during the power-off (standby mode) is reduced or minimized.

Note that the above-described predetermined time d to be selected or designed depends on the values of other time parameters. One time parameter is a time from when the driver controller 4 receives a stop signal Ss for stopping the timing signal TS to when the timing signal TS is actually stopped. Another time parameter is a time from when the driver controller 4 receives a power switching signal Sc to when the power of the image data PD is actually switched to a low power for output as a low power signal. Yet another time parameter is a time from when the data driver 3 receives a last timing signal TSr to when the output of the image data PD to the liquid crystal panel 2 is actually started.

Any value can be used for the predetermined time d if the time d is sufficiently long so that when the driver controller 4 receives a stop signal Ss for the stopping the timing signal TS and also receives a power switching signal Sc after the predetermined time d from the stop signal Ss, the sufficient time (sufficiently long time) allows the driver controller 4 to switch the power of the image data PD to a lower power (low power signal) always after the trailing edge of a last output timing signal TSr pulse) of the timing signal TS. For example, the predetermined time d can be a time slightly shorter than the constant interval t of the timing signal TS output (generated) by the driver controller 4. More specifically, in the case where the liquid crystal television 1 is based on a standard liquid crystal television, a representative example of the predetermined time d is about 30 ms.

The present invention has been described above using presently preferred embodiments, but such description should not be interpreted as limiting the present invention. Various modifications will become obvious, evident or apparent to those ordinarily skilled in the art, who have read the description. Accordingly, the appended claims should be interpreted to cover all modifications and alterations which fall within the spirit and scope of the present invention.

This application is based on Japanese patent application 2007-267144 filed Oct. 12, 2007, the content of which is hereby incorporated by reference.

What is claimed is:

1. A liquid crystal display device comprising:

a liquid crystal panel;

a data driver for outputting image data to the liquid crystal panel;

timing signal output means for supplying a timing signal to the data driver for allowing the data driver to output image data at predetermined intervals;

image data output means for switching image data from an image data source between a low power signal for standby mode and a high power signal for normal mode so as to output, to the data driver, the image data as either the low power signal or the high power signal; and power-off control means for outputting a stop signal to the timing signal output means, when a user selects power-off, so as to allow the timing signal output means to stop the supply of the timing signal until switching to the standby mode is completed, and for outputting a power switching signal to the image data output means so as to allow the image data output means to switch the image data to the low power signal for the standby mode, wherein the power-off control means outputs the power switching signal after a predetermined time from the stop signal so as to allow the image data output means to switch the image data to the low power signal for the standby mode under no timing signal, wherein the timing signal is a pulse signal having pulses at predetermined intervals, each having a leading edge and a trailing edge, wherein the time from when the power-off control means outputs the stop signal to when the power-off control means outputs the power switching signal is a sufficient time to allow the image data output means to switch the image data to the low power signal for output after the trailing edge of a last pulse of the timing signal output from the timing signal output means, and wherein the time from when the power-off control means outputs the stop signal to when the power-off control means outputs the power switching signal is shorter than each of the intervals of the timing signal output from the timing signal output means.

* * * * *